US007543927B2

(12) United States Patent
Campillo et al.

(10) Patent No.: US 7,543,927 B2
(45) Date of Patent: Jun. 9, 2009

(54) PRINT MEDIA EDGE PRINTING

(75) Inventors: Alejandro Campillo, Barcelona (ES); Joaquim Veciana, Barcelona (ES); Ezequiel Jordi Rufes, Sant Fellu de Llobregat (ES); Angel Cercos, Barcelona (ES); Marc Serra, Barcelona (ES); Daniel Gonzalez, Terrassa (ES); Antonio Hinojosa, Rubi (ES); Servando Rodriguez, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 496 days.

(21) Appl. No.: 11/033,654

(22) Filed: Jan. 13, 2005

(65) Prior Publication Data

US 2005/0179758 A1 Aug. 18, 2005

(30) Foreign Application Priority Data

Jan. 13, 2004 (EP) ..... 04100098

(51) Int. Cl.
*B41J 2/01* (2006.01)

(52) U.S. Cl. ..... 347/101; 347/104

(58) Field of Classification Search ..... 347/14, 347/16, 19, 104, 41.4, 5, 9, 101, 41, 40
See application file for complete search history.

(56) References Cited

U.S. PATENT DOCUMENTS

| | | | | |
|---|---|---|---|---|
| 6,796,648 | B2 * | 9/2004 | Ohashi | 347/104 |
| 6,840,617 | B2 * | 1/2005 | Crosby et al. | 347/104 |
| 2002/0089564 | A1 | 7/2002 | Ohashi | |
| 2002/0130910 | A1 | 9/2002 | Otsuki | |
| 2003/0103101 | A1 | 6/2003 | Otsuki | |
| 2004/0257421 | A1 * | 12/2004 | Yokoyama et al. | 347/104 |

* cited by examiner

*Primary Examiner*—Manish S Shah

(57) ABSTRACT

In printing apparatus, when printing near the end of a print media with a printhead having nozzles, a controller causes a print drive to produce a large print media advance movement together with the use of a different group of nozzles from that used for the rest of the print media. This avoids printing art effects as the print media leaves a pinch in a media feed. In one embodiment the number of nozzles used for printing in the end region is reduced, and the centre of the group of nozzles is simultaneously shifted in the direction of print media advance. The size of the print media advance is also changed in the end region. The printing mask used is also changed.

12 Claims, 5 Drawing Sheets

PRINT MEDIA EDGE PRINTING

BACKGROUND TO THE INVENTION

The present invention relates to printing at or near the edges or ends of print media by hardcopy devices. In particular it relates to so-called bleed printing or zero margin printing in which printheads of a hardcopy device apply ink to a print media right up to, and in some cases beyond, its edges.

When printing a sheet of print media in a hardcopy device, it is fed on to a platen in the print zone in a controlled manner by passing it between a feed roller and a pinch wheel. When the page or sheet has an unprinted bottom margin of conventional size, good print quality can be maintained throughout the sheet, since the trailing edge of the sheet remains held between the feed roller and the pinch wheel until printing of the sheet has finished. When, however, the sheet is to be printed with a relatively small bottom margin, or no margin at all, the sheet is released from the pinch between the feed roller and the pinch wheel before printing is finished and this causes a discontinuity in the printing due to the associated jump in the spacing between the printhead and the print media passing beneath it.

When undertaking full bleed printing, it is known to fire ink out of the printhead nozzles even slightly beyond the end of the page. This ensures that, even in the event of positioning errors, there are no blank areas without ink at the edge of the sheet of print media. This printing out of the page requires an ink collection arrangement in the platen to absorb the ink so that it does not mark subsequent sheets of print media. The provision of such an ink collection arrangement takes up a considerable amount of space. In addition, its size requires that the printhead and its associated print zone are at a considerable spacing from the traction system, viz. the feeder roller and the pinch wheel.

SUMMARY OF THE INVENTION

Embodiments of the present invention seek to overcome or reduce the above problems.

According to a first aspect of the present invention there is provided a method of printing on a print media using nozzles in a printhead, the print media being advanced past the printhead by print media feed means, wherein, when an end of the media is released by the feed means, the method comprises the steps of causing the media to undertake a relatively large media advance movement and correspondingly using different nozzles of the printhead to print on the media.

An advantage of the above method is that printing artifacts adjacent the end of a media are reduced.

Preferably the print media includes a main region and an end region at said end, and printing occurs on said main region using a first group of adjacent ones of said nozzles extending in a direction parallel to the direction of media advance, and printing occurs on said end region using a second group of adjacent ones of said nozzles extending in said direction.

There may be no nozzles in common in said first and second groups.

Alternatively some or all of the nozzles in said second group are also in said first group.

The end region of the print media may be at the top of a sheet or at the bottom of a sheet.

In preferred embodiments, the transition between said main region and said end region or margin of the print media is defined by the position at which the print media is no longer driven by a feed or drive means thereof. The feed means may be the combination of a feed roller and a pinch wheel or roller which, before the transition, holds the print media in a controlled manner.

In one embodiment, printing occurs up to the transition, then the print media undergoes a relatively large advance movement, and then printing continues further. No changes need to be made to the size of the print media advance movements before and after the transition, nor to the printing mask used.

In another embodiment, the swath height used in printing is reduced before the transition, and the print media advance movements before and after the transition are different.

In preferred arrangements the reduction in swath height is accompanied by the introduction of multi-pass printing. The introduction of multi-pass printing may precede or follow the reduction in swath height, but in preferred arrangements the two processes overlap in time.

Arrangements in accordance with the present invention are particularly suitable for improving the printing quality at the bottom edge of a sheet of print media, i.e. the last region of the sheet to be printed.

According to a second aspect of the present invention, there is provided a printing apparatus comprising a printhead arranged to print ink from a first part thereof onto a print media in a printing zone, means for feeding the print media through said printing apparatus in a media advance direction, and means for detecting the approach of an end region of the print media wherein means are provided, in response to said detecting means, to cause the feeding means to advance the print media by a relatively large advance movement, and to cause the printhead to print ink from a second part thereof, which, relative to the first part, is shifted along the printhead in the direction of media advance.

According to a third aspect of the present invention, there is provided a method of printing by a printhead in and approaching the end region of a print media wherein in a first phase the swath height is gradually reduced while the size of the print media advance is maintained at a first reduced value, and in a second phase the swath height is maintained at a reduced value while the size of the print media advance is maintained at a second, further reduced value.

An advantage of a single change in print media advance over a plurality of changes is that it reduces the number of locations at which printing artefacts might be introduced by changing. Moreover, fewer control instructions are required to effect the change.

As used herein, the expression "printing apparatus" covers all types of printers and other types of hardcopy device such as facsimile machines, photocopiers and scanners.

A single printhead may be provided for a single colour, e.g. black. Alternatively, the apparatus may comprise a plurality of printheads corresponding to different coloured inks. An additional printhead may be provided for applying fixer to the print media. A fixer is a liquid applied to a print media to restrict the spreading of another liquid (usually ink) through the print media and/or to improve its visual appearance; thus the term "ink" as used herein also covers "fixer".

A "printing mask" is a means for preventing certain nozzles of a printhead from firing, even if printing instructions from a printing controller should include an instruction to fire. It is typically configured in the control instructions of a printing apparatus.

The term "transition" as used herein means, according to context, the time period or the spatial region in which printing changes between a normal operation in the main region of a print media and a special operation in an end region of the print media. The transition may be a gradual process or it may occur substantially instantaneously. It will be appreciated that "transitions" occur at both ends of a print media.

BRIEF DESCRIPTION OF THE DRAWING

Preferred embodiments of the present invention will now be described, by way of example only, with reference to the accompanying drawings, of which.

DESCRIPTION OF THE PREFERRED EMBODIMENTS

Figure 1:
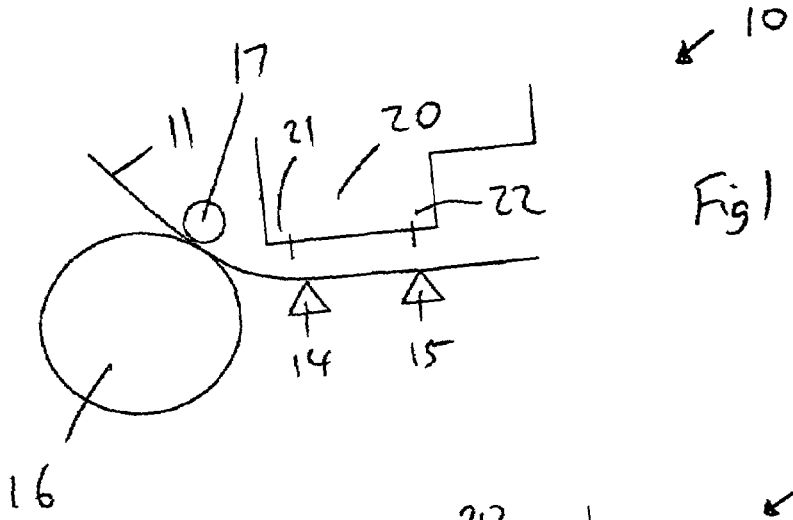
FIGS. 1 to 4 are schematic sectional side views of the printing mechanism of a prior art printer as a sheet of print media advances therethrough.

Referring to the drawings, FIGS. 1 to show the printing mechanism 10 of a prior art ink-jet printer. A print media 11 is advanced in controlled manner over a ribbed platen represented schematically by ribs 14,15. The print media is held between a feed roller 16 and an associated pinch wheel 17, and as roller 16 is rotated by an associated motor (not shown), the print media is advanced beneath a printhead 20. Printhead 20 typically includes two rows of nozzles which fire ink on to the print media, and lines 21 and 22 indicate the positions of the end nozzles which are used for printing FIG. 1 shows the normal situation in which a main region of print media 11 (i.e. a region remote from its edge) is being printed. It will be noted that the media 11 is constrained by roller 16 and pinch wheel 17 to curve gently between the pinch and the print zone so that it lies substantially flat on ribs 14,15 thus enabling a high print quality to be maintained.

Figure 2:
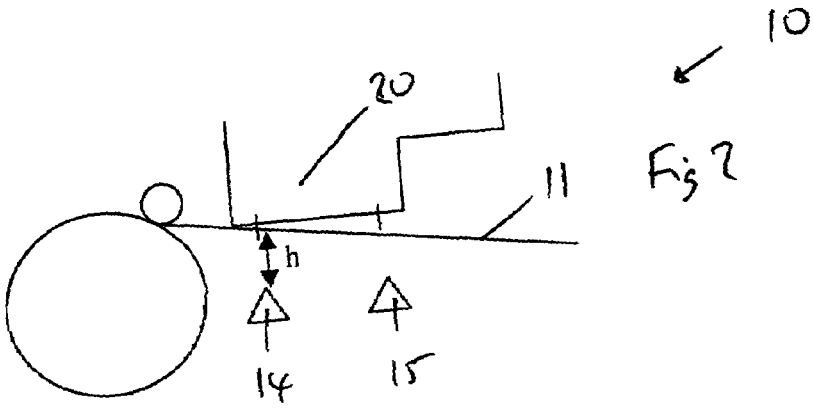

In FIG. 2, the feed roller 16 has been rotated so that the print media 11 has advanced just so far as to be released from the pinch between roller 16 and pinch wheel 17. This produces a "pop-up effect" as the print media is freed to adopt an unconstrained straight shape which is associated with a lifting movement of the print media off ribs 14,15. After release from the pinch, the print media continues to be advanced by overdrive rollers (not shown) located to the right in FIGS. 1 to 4. As the print media keeps advancing, FIG. 3, the trailing edge 31 of the print media rides down the face of roller 16.

Figure 3:
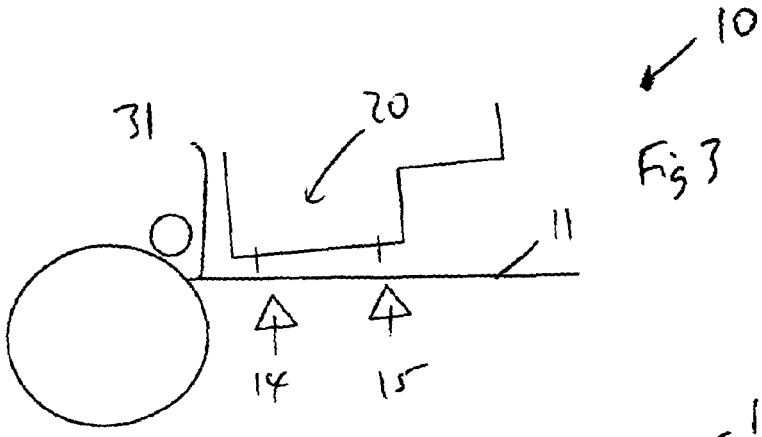
Figure 4:
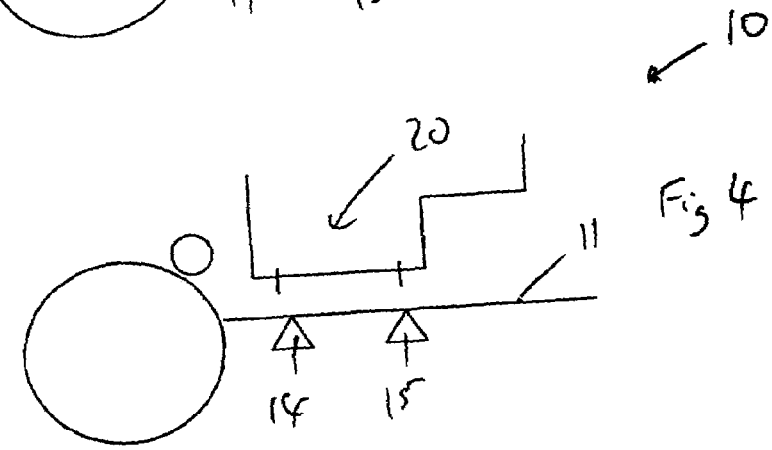

The print media eventually reaches the configuration shown in FIG. 4 in which it again lies substantially flat on the ribs 14,15 and the "pop-up effect" is over. The process which occurs between FIG. 1 and FIG. 4 is known as "the transition". The portion on the print media where it occurs is known as the transition region, and the time over which it occurs is known as the transition period. Throughout the print media movements illustrated in FIGS. 1 to 4, a uniform media advance is maintained, together with a uniform printing swath height.

Figure 5:
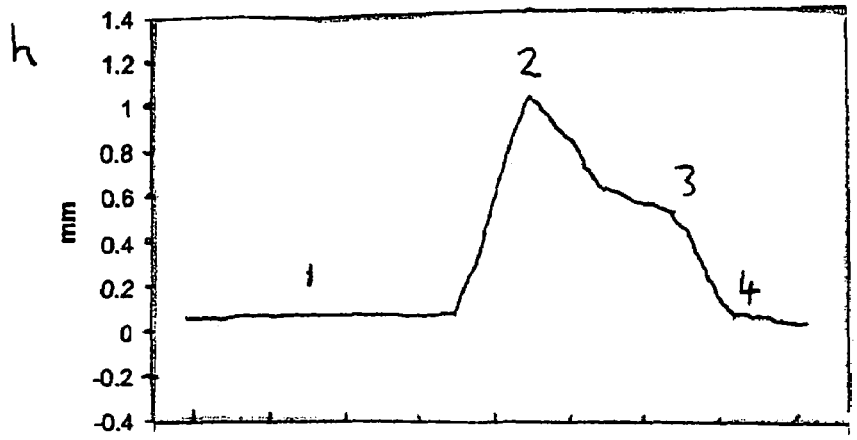
FIG. 5 is a graph, illustrating the change in the spacing between the print media and the underlying platen as the print media is advanced through the printing mechanism of FIGS. 1 to 4.

FIG. 5 illustrates the spacing "h" (indicated in FIG. 2) in mm between rib 14 and the point on the print media 11 immediately above it as the print media advances through the printing mechanism, with numerals 1 to 4 indicating the spacings in the configurations illustrated in FIGS. 1 to 4 respectively. Because of the jump of over 1 mm in printhead to paper media spacing around the time of the FIG. 2 configuration and the subsequent delay until it returns to its desired position as shown in FIG. 4, there is a discontinuity in the pattern of ink drops applied to print media 11 and a printing artefact results, thus causing a decrease in print quality. During this period the shape of the print media also changes so that the relevant region of the print media is disposed at an angle to the plane of the nozzle plate of the printhead, which leads to further printing imperfections.

It will be noted that the distance "h" shown in FIG. 5 is related to the distance "x" between the printhead and the print media (also known as the "pen to printhead" spacing or PPS) by the equation $h+x=z$, where z is the distance between the printhead and the tops of the ribs 14,15 of the platen.

Figure 6:
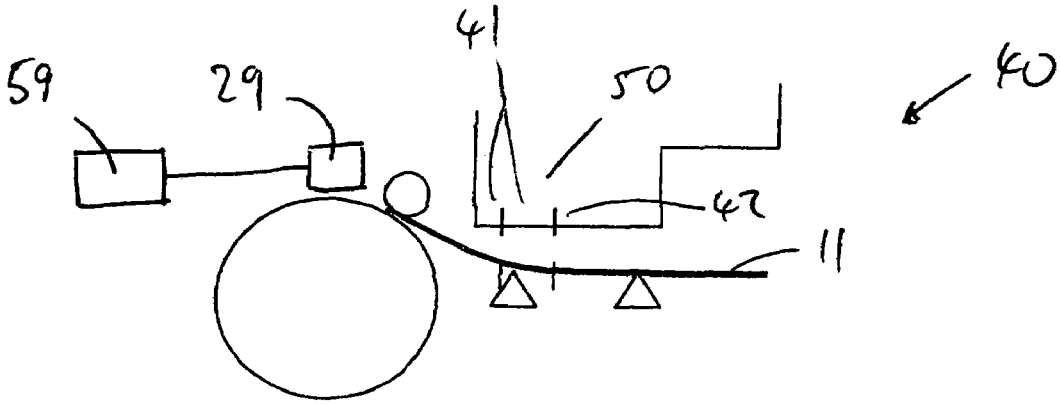
FIGS. 6 and 7 are views corresponding to FIGS. 1 and 4 respectively of a printing mechanism operating in accordance with a first embodiment of the present invention.
Figure 7:
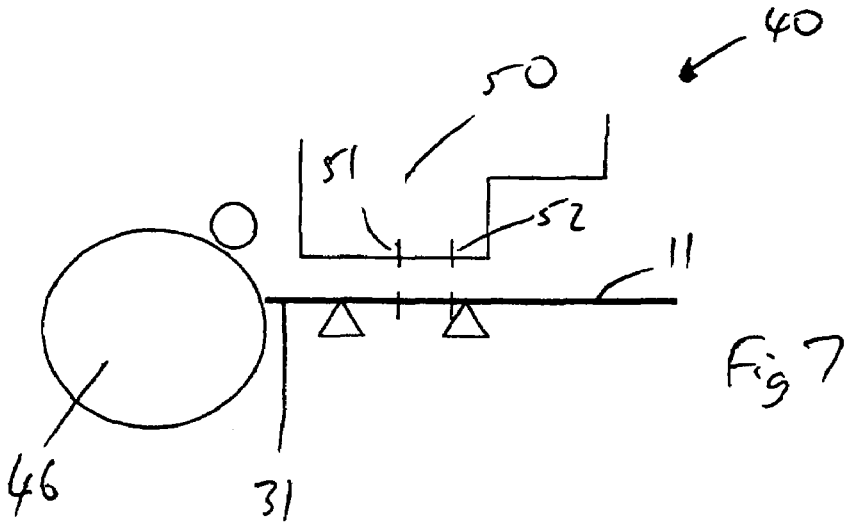

Referring now to FIGS. 6 and 7, a first embodiment of the present invention comprises a printing mechanism 40 similar to that shown in FIGS. 1 to 4. However, it will be seen from FIG. 6 that only the nozzles in the group located between lines 41 and 42 in the left-hand side of the printhead 50 are used to fire ink onto the main central region of the print media 11. In FIG. 6, the paper media 11 is just about to be released from the pinch.

The printing process is under the control of a printing controller 59. As printing proceeds down the print media, the position of the trailing edge 31 of print media 11 is monitored by a paper sensor 29 directly (e.g. optically) and/or indirectly (e.g. by summing the preceding print media advance movements). Sensor 29 is connected to controller 59. In the present embodiment, instead of continuing uniform medium advances through the positions indicated in FIGS. 2 and 3, the print media is caused to undertake a relatively long advance movement to the position indicated in FIG. 7 in which the trailing edge 31 has cleared the feed roller 46. Thus the troublesome area indicated in FIG. 5 in the region of the positions of FIGS. 2 and 3, is completely avoided.

In order to avoid a corresponding gap in the ink dots applied to the print media 11, a different group of nozzles of printhead 50 is used to fire ink. This group is bounded by lines 51,52 in FIG. 7. Lines 51,52 are the same distance apart as lines 41,42 indicating that the same number of nozzles is used and thus that the printing swath height used is kept constant. It will be noted that the nozzles used in FIG. 7 are to the right of those used in FIG. 4 i.e. shifted in the direction of medium advance away from the feeding-in arrangement. It will also be noted that the size of the long advance movement is equal to the distance between lines 41 and 52.

No printing occurs while the long advance movement is being undertaken, but a printing pass is undertaken thereafter before the next normal advance. Accordingly, it will be seen that the nozzle shift distance, i.e. the distance between lines 41 and 51 corresponds to the size of the long media advance movement minus the normal width of one printing pass (or swath height). In this way, the top edge of the first swath printed after the long media advance (i.e. in the FIG. 7 position) is directly adjacent to the bottom edge of the last swath printed before the long media advance (i.e. in the FIG. 6 position). Thus there should be no gap between, or overlapping of, the ink dots forming the printed matter.

Printing of the edge region of the print media then continues up to the trailing edge 31 using the right hand group of nozzles with the same swath height and with the same size of media advance as before the single long advance (i.e. the same advance as for the main region of the print media).

Figure 8:
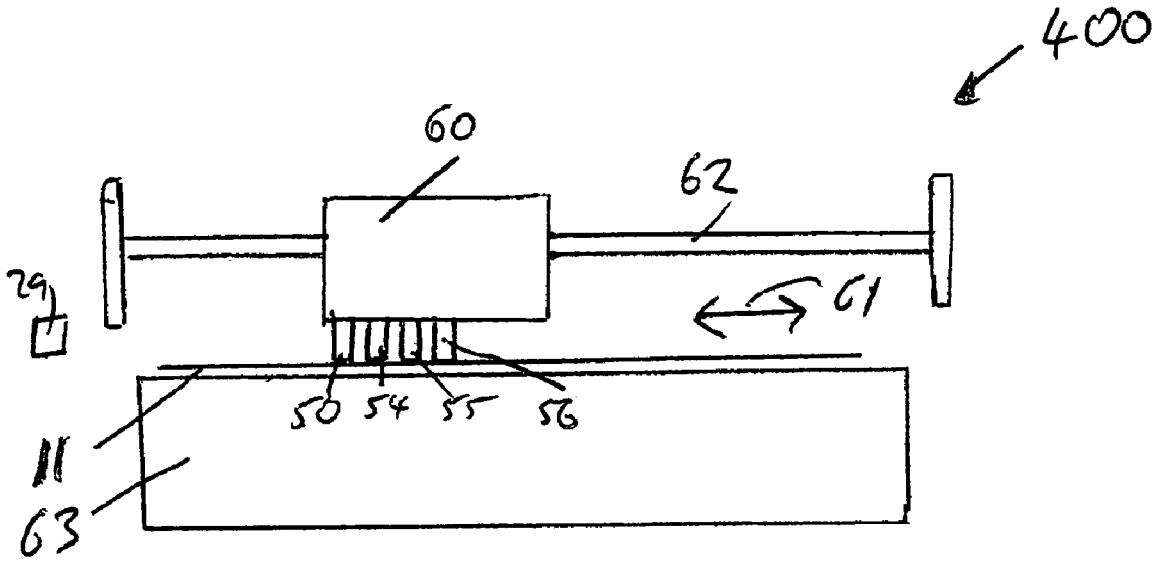
FIG. 8 is a view of a printer incorporating the printing mechanism of FIGS. 6 and 7.

A schematic front view of a printer 400 including the printing mechanism 40 of FIGS. 6 and 7 is shown in FIG. 8. A scanning printhead 50 is mounted on a carriage 60 which reciprocates in the directions indicated by double-headed arrow 61 over print media 11, i.e. perpendicular to the direction of media advance. Carriage 60 is mounted to slide on a fixed bar 62 of the printer. The print media 11 moves over a fixed printing platen 63. The bar 62, the platen 63 and the print media sensor 29 are fixedly mounted on a chassis of the printer 400.

Figure 9:
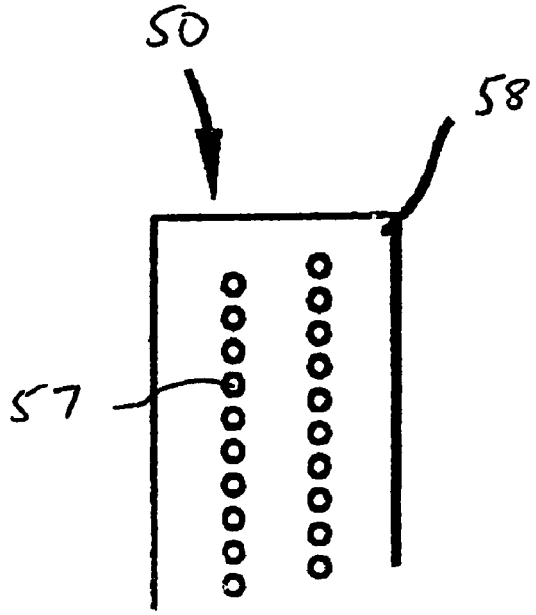
FIG. 9 is an enlarged view of the nozzle plate of a printhead.

The pattern of nozzles 57 in the nozzle plate 58 of printhead 50 is shown schematically in FIG. 9. The nozzles 57 are arranged in an array comprising two lines, with the nozzles in one line being staggered relative to the nozzles in the other line.

An advantage of the arrangement described in connection with FIGS. 6 and 7 is that it reduces the printing artefacts arising during bleed printing. Because the time used to undertake the long advance movement is negligible compared with the drying time of the ink, the respective swaths of ink immediately preceding and succeeding the long advance merge as normal without problems.

The size of the long advance movement is considerably smaller than the length of the printhead, so that it is always possible to move the nozzles used by the required distance. In addition, since the point of release of the pinch can vary slightly, it is possible to incorporate a safety margin so that there is no danger of pinch release occurring before the long advance is undertaken.

Since less than half the nozzles of the printhead 50 are employed at any one time, this provides the opportunity of reducing the amount of hardware required for the printing instructions, or alternatively of providing higher printing resolution.

The size of the single large media advance may be between two and twenty times the size of the normal media advance and preferably five to ten times.

In a modification, substantially all the nozzles of printhead 50 are used to print the main region of the print media; it is only when the FIG. 1 position is approached that the reduced nozzle group and a correspondingly smaller media advance are employed. This has the advantages of achieving a higher throughput and more even use of the nozzles of the printhead.

Arrangements according to the invention can be used to print images which bleed over the bottom edge of the print media, and/or forms or other documents, the text of which extends at least partly into the bottom margin.

The printhead can be used to fire black ink or a coloured ink or fixer on to the print media. Arrangements according to the invention may incorporate a plurality of printheads 54,55,56 FIG. 8 firing different inks on to the print media. As shown in FIG. 8, the printhead may be a scanning printhead, which undertakes scanning movements across the print media. Alternatively, it may be a fixed printhead which extends across the entire width of the printing mechanism in a page wide array type of device.

Arrangements in accordance with the present invention may be used in printers other than inkjet printers and in various types of hardcopy device.

Although the above-described embodiment has numerous advantages, the relatively large size of the single media advance compared to the size of the normal media advance means that any error in the amount of the advance is likely to be greater. Such an error could be due to manufacturing tolerances. This would lead to a printing artefact remaining in the printed matter. Another possible drawback is that the use of a different group of nozzles after the transition means that they will have different dot placement characteristics from the nozzles used before the transition; in the absence of additional steps to overcome the dot placement errors, this factor may also introduce a printing artefact at the transition.

A second embodiment of the present invention, which seeks to remove or at least further reduce the remaining printing artefacts, will now be described in connection with FIGS. 10 to 13.

Typically a scanning printhead comprises 304 nozzles arranged in two lines, of which 288 nozzles are used to fire ink on to a print media. To avoid print defects, it is usually the nozzles at the ends of the lines which are not used. In the second embodiment, the main region of the print media is printed in four passes with swaths having effectively full swath height, i.e. 288 nozzles. This will be called Print Mode A. As the bottom edge region is approached the number of nozzles used to fire ink is progressively reduced. This involves two stages: firstly the modification of the printing mask so that a reduced number of nozzles is used, and secondly the print media advance is reduced. Printing in the second stage will be called Print mode B.

Figure 10:
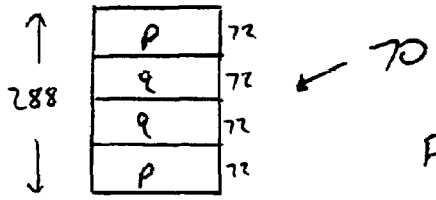
FIG. 10 shows a first printing mask employed in a second embodiment of the present invention.

FIG. 10 shows the printing mask 70 used in the first stage, which is divided into four quarters corresponding to 72 nozzles each. The mask is tapered, i.e. the light dot density "p" in the top bottom region 71, 77 is less than the heavy dot density "q" in the two centre regions 73, 74. The print medium advance is a distance corresponding to 72 nozzles.

Figure 11:
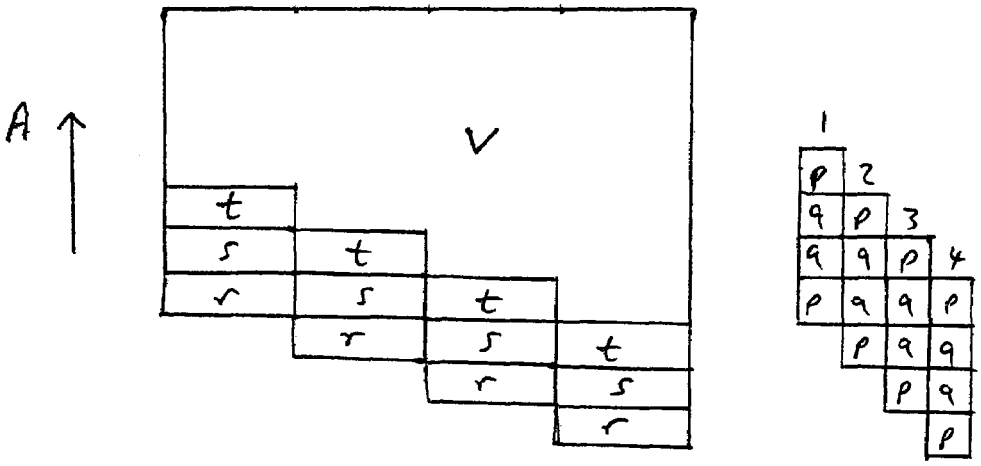
FIG. 11 shows a pattern of ink applied to a print media using the print mask of FIG. 10.

FIG. 11 shows the pattern of ink dots applied to the print media after four passes of the mask 70. Arrow A indicates the direction of movement of the print media relative to the nozzles. Regions "r" are light, having been printed with dot density p. Regions "s" are slightly darker having been printed with dot density p and dot density q. Regions "t" are slightly darker still having been printed with dot density p and twice with dot density q. Region "v" corresponds to full dot density and is the darkest region, having been printed twice with dot density p and twice with dot density q. During this stage the swath height remains at 288 nozzles.

Figure 12:
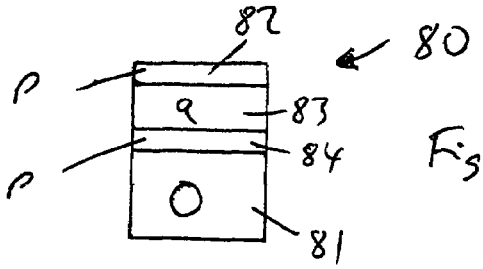
FIG. 12 shows a second printing mask employed in the second embodiment of the present invention.
Figure 13:
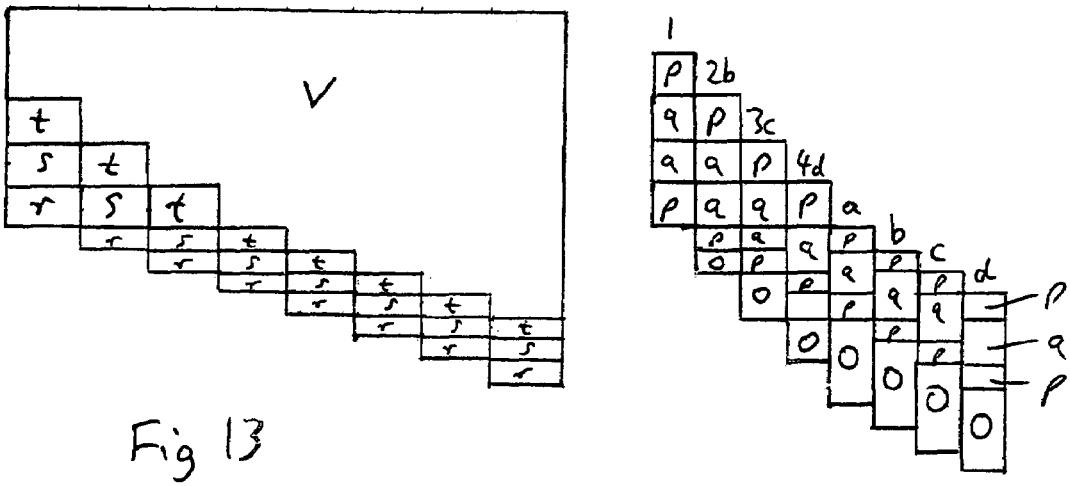
FIG. 13 shows a pattern of ink applied to a print media using the print mask of FIG. 12.

However, in the region of the transition it is also desired to reduce the swath height from 288 nozzles to 144 nozzles. FIG. 12 shows the printing mask 80 which it is desired to use. The symbol O indicates that the bottom half 81 is blank, or in other words the nozzles nearer to the feed roller 16 are not used. The top half of the mask retains the tapering feature by being divided into four regions 82-84 with a pattern of dot densities p and q as before.

To enable a smooth transition, there is not an abrupt change from mask 70 to mask 80, but rather a number of passes during which part of the printhead uses mask 70 and the other part uses mask 80. This process is described in connection with FIG. 13. The swath heights, paper advances and masks used are given in Table 1.

TABLE 1

| | Swath height | Paper advance | Masks 70 | Masks 80 |
|---|---|---|---|---|
| I | 288 | 72 | 1 (288 noz) | — |
| II | 252 | 72 | 2 (216 noz) | b (36 noz) |
| III | 216 | 72 | 3 (144 noz) | c (72 noz) |
| IV | 180 | 72 | 4 (72 noz) | d (108 noz) |
| V | 144 | 36 | — | a (144 noz) |
| VI | 144 | 36 | — | b (144 noz) |
| VII | 144 | 36 | — | c (144 noz) |
| VIII | 144 | 36 | — | d (144 noz) |

The first pass I shown has a swath height of 288 nozzles corresponding to FIG. 11. In the second pass II, three quarters of the nozzles of the printhead located further from the feed roller 46 employ mask 2 (one of the masks like 70), and half of the remainder, i.e. 36 nozzles employ a modified mask b (one of the masks like 80). The third pass III employs half of mask 3 (one of the masks like 70) and half of the remainder i.e. 72 nozzles, employ a modified mask c (one of the masks like 80). The fourth pass IV employs a quarter of mask 4 (one of the masks like 70) and half of the remainder, i.e. 108 nozzles, employ a modified mask d (one of the masks like 80). Passes V to VIII employ the tapered mask 80 which then continues until printing finishes. It will be seen that the four-pass printing of the main region of the print media 11 has eventually been superseded by four-pass printing adjacent the bottom edge, using only the half bottom pen (144 nozzles). The eighth pass VIII is preferably concluded before the print media sheet leaves the pinch between feed roller 16 and print wheel 17. Once pass VIII is finished a complete cycle of Print Mode B will have been completed and passes V, VI, VII and VIII are repeated until the end of the document.

An advantage of the second embodiment is that the dynamic and progressive change in the use of the nozzles reduces banding in the resulting printed image or other printed matter. In particular, this avoids the adverse effects of changes in interactions between the ink and the print media such as coalescence. The way in which an ink is taken up by a media depends upon whether ink has previously been applied to the same location and, if so, how much ink and how recently. By making any changes gradually, these effects are made invisible in the final printed matter. In this connection, the masks of FIG. 8 and 10, which produce printing initially with a low density of dots, have the advantage that such a low density is relatively quickly absorbed by the media, and also that, once some ink has been absorbed any subsequent ink applied is absorbed more quickly.

By using full swath height printing for the main region of the print media, throughput is kept high. Since the changes in swath height, media advance and masks used should be completed before the print media is released from the pinch between the feed roller 46 and the pinch wheel, the changes described in connection with FIG. 11 are preferably introduced seven or eight passes before the print media release.

Various modifications may be made to the above-described second embodiment. For example, the changes in the swath height and printing mask may be introduced at an earlier stage to ensure that the changes are completed before the transition commences. However, if it is introduced too early, there may be a significant reduction in throughput.

The changes described in swath height, amount of paper advance and the printing masks are examples only, and it will be understood that a wide range of values can be used and also a wide range of the times, or positions on the print media, at which they are started and completed.

The ratio of the ink dot densities in regions q and p may lie within the range 1.5:1 to 5:1, preferably between 1.5:1 and 3:1 and most preferably 2:1.

The features and modifications of the first and second embodiments may be interchanged or combined as described.

Figure 14:
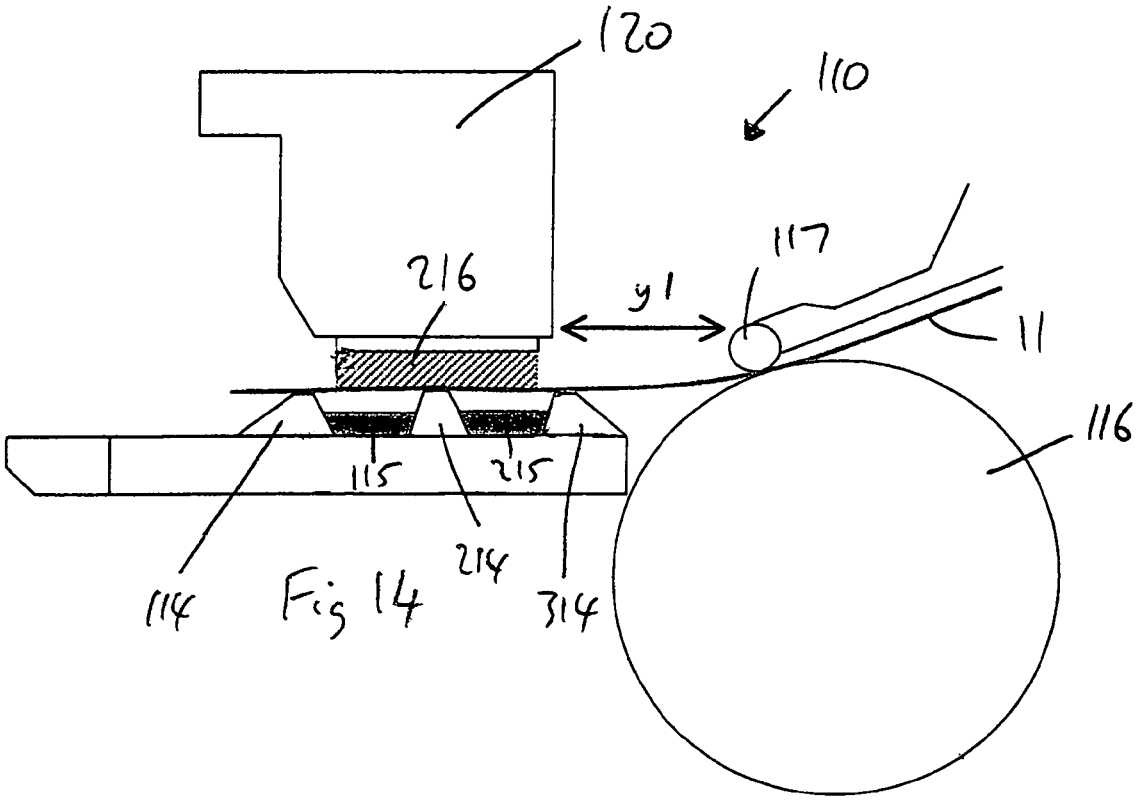
FIG. 14 shows a schematic sectional side view of a prior art printing mechanism using substantially all of a printhead.

Before turning to a third embodiment of the present invention, reference will first be made to a prior art printing mechanism 110 shown in FIG. 14. The mechanism comprises a feeder roller 116 and an associated pinch wheel 117 which feed a sheet of print media 11 towards a print zone on a platen comprising ribs 114, 214, 314 extending across the width of the platen in a direction perpendicular to that of print media advance beneath a printhead 120. In the channels formed between the ribs 114, 214 and 214, 314 there are provided strips of ink-absorbent material 115, 215 which serve to absorb ink fired during a full bleeding printing operation as described in the introduction. Substantially the whole length of printhead 120 is employed, indicated by region 216, so that it is necessary to provide absorbent material beneath the whole of region 216. In the mechanism of FIG. 12, this means that the end ribs 114, 314 need to be located substantially outside the region 216. This leads to there being a separation "y1" between the printhead 120 and the pinch wheel 117. The size of separation y1 is typically in the region of 15 mm. For the particular printhead shown in FIG. 14, the size of region 216 corresponds to 296 nozzles.

Figure 15:
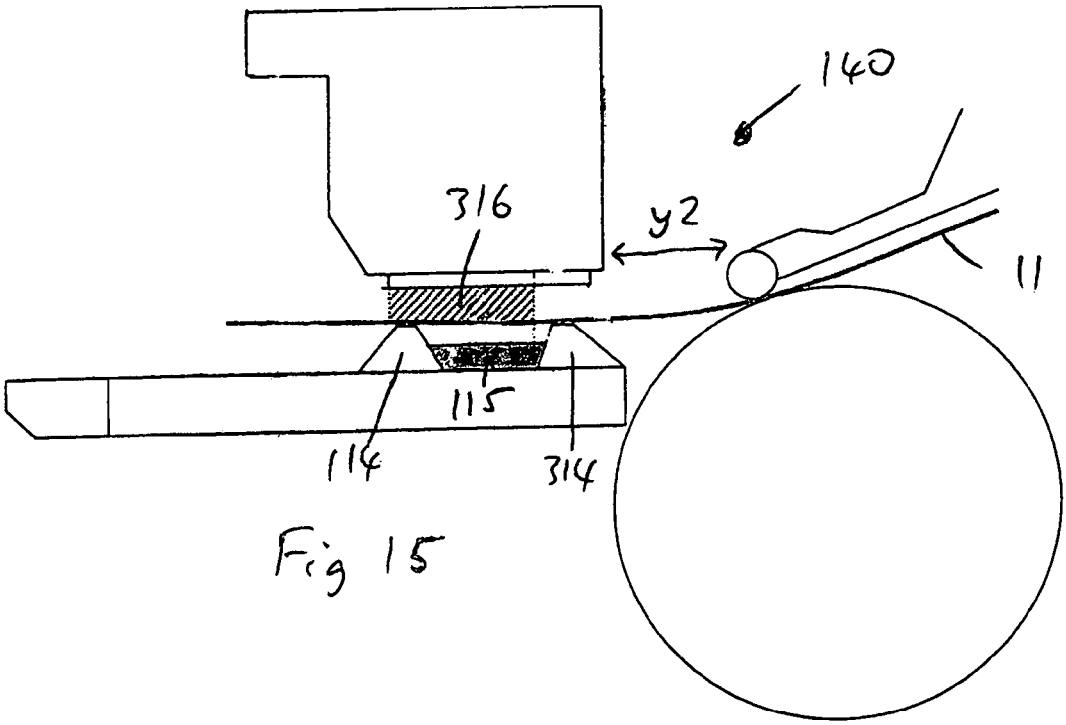
FIG. 15 shows a view corresponding to FIG. 14 of a printing mechanism in accordance with a third embodiment of the present invention.

There will now be described a printing mechanism 140 in accordance with a third embodiment of the present invention as shown in FIG. 15. During printing of the end region of a sheet of print media 11, the group of nozzles used for firing ink is reduced in size, as in the previously-described first or second embodiment, and shifted along the printhead 120 in a direction away from the pinch wheel 117. In view of the reduced length of this group of nozzles, indicated by region 316 in FIG. 15, there is only a requirement for an ink collection region of reduced size. Accordingly, the printing platen comprises two ribs 114, 314 with a single strip 115 of ink-absorbent material provided in a channel therebetween. In this arrangement, the ribs 114, 314 may be located partially beneath printhead 120 leading to a saving in space. In particular the separation "y2" between the printhead 120 and the pinch wheel 117 in FIG. 15 is less than the corresponding dimension "y1" in the mechanism 110 of FIG. 14. The size of the separation y2 is typically in the region of 3 mm so that the printhead is approximately 12 mm closer to the pinch wheel than in the mechanism of FIG. 14. The size of region 316 corresponds to approximately one half to two thirds of the printhead, i.e. to between 148 and 198 nozzles.

Besides the reduction of artefacts in the printed matter, arrangements according to the present invention also allow space to be saved in the region of the platen of a hardcopy device. Thus a specific advantage of the third embodiment is that the print zone is nearer to the traction system so that the location of the transition region on the print media can be lower down the page and the shape of the print media can be more accurately controlled for longer. Moreover, there is provided a more compact ink-collection arrangement requiring fewer components. Although ribs 114,314 are still necessary to prevent the ink absorbent material 115 marking the rear of the paper media, the proportion of printhead with absorbent material 115 therebelow is increased. In the arrangement described, only one strip of ink absorbent material is required.

Various modifications may be made to the third embodiment. For example, the number and size of the ribs forming the platen and the number, size and shape of the strips of ink-absorbent material therebetween may be chosen as described.

The mechanism of the third embodiment may also be used for bleed printing at the top of a sheet of print media in addition to bleed printing at the bottom as described in connection with FIG. 15. At the top edge of the sheet it is simply necessary to arrange for the nozzles in region 316 to be used. The transition between the printing in the top end region and printing in the main region is effected in a similar way as described above.

The features and modifications of the third embodiment may be interchanged or combined as appropriate with those of the first and second embodiments.

What have been described and illustrated herein are preferred embodiments of the invention along with some of its variations. The terms, descriptions and figures used herein are set forth by way of illustration only are not meant as limitations. Those skilled in the art will recognise that many variations are possible within the spirit and scope of the invention, which is intended to be defined by the following claims—and their equivalents—in which all terms are meant in their broadest reasonable sense unless otherwise indicated.

What is claimed is:

1. A method of printing on a print media using nozzles in a printhead, the print media having an end and being advanced past the printhead by print media feed means in a print media advance direction, wherein, when said end of the print media is released by the feed means, the method comprises the steps of causing the print media to undertake a relatively large print media advance movement and correspondingly using different nozzles of the printhead to print on the print media, wherein the print media includes a main region and an end region at said end, and printing occurs on said main region using a first group of adjacent ones of said nozzles extending in a direction parallel to the direction of print media advance, and printing occurs on said end region using a second group of adjacent ones of said nozzles extending in said direction, wherein in said main and end regions, the print media undergoes an advance movement between each application of ink by the printhead nozzles, and around a transition between said main region and said end region, the size of the print media advance movement is changed so that the print media advance movement in said end region is smaller than the print media advance movement in said main region.

2. A method according to claim 1, wherein the centre of said second group of adjacent nozzles used on said end region is shifted in the direction of print media advance relative to the centre of said first group of adjacent nozzles used on the main region.

3. A method according to claim 2, wherein the size of said relatively large print media advance movement is substantially equal to the distance between the centres of said first and second groups of adjacent nozzles.

4. A method according to claim 1, wherein, around a transition between said main region and said end region, the number of nozzles used for printing is changed, so that fewer nozzles are used in said end region than in said main region.

5. A method according to claim 1, wherein different printing masks are used around the transition between said main region and said end region.

6. A method according to claim 1, wherein the feed means comprises a feed roller element and an associated pinch element defining a pinch therebetween and the release of the print media by the feed means is constituted by the print media leaving said pinch.

7. A method of printing on a print media using nozzles in a printhead. the print media having an end and being advanced past the printhead by print media feed means in a print media advance direction, wherein, when said end of the print media is released by the feed means, the method comprises the steps of causing the print media to undertake a relatively large print media advance movement and correspondingly using different nozzles of the printhead to print on the print media, wherein the print media includes a main region and an end region at said end, and printing occurs on said main region using a first group of adjacent ones of said nozzles extending in a direction parallel to the direction of print media advance, and printing occurs on said end region using a second group of adjacent ones of said nozzles extending in said direction, wherein, around a transition between said main region and said end region, in a first phase the swath height is gradually reduced while the size of the print media advance is. maintained at a first reduced value, and in a second phase the swath height is maintained at a reduced value while the size of the print media advance is maintained at a second, further reduced value.

8. A method according to claim 7, wherein the centre of said second group of adjacent nozzles used on said end region is shifted in the direction of print media advance relative to the centre of said first group of adjacent nozzles used on the main region.

9. A method according to claim 8, wherein the size of said relatively large print media advance movement is substantially equal to the distance between the centres of said first and second groups of adjacent nozzles.

10. A method according to claim 7, wherein, around a transition between said main region and said end region, the number of nozzles used for printing is changed, so that fewer nozzles are used in said end region than in said main region.

11. A method according to claim 7, wherein the feed means comprises a feed roller element and an associated pinch element defining a pinch therebetween and the release of the print media by the feed means is constituted by the print media leaving said pinch.

12. A method of printing by a printhead in and approaching the end region of a print media wherein in a first phase the swath height is gradually reduced while the size of the print media advance is maintained at a first reduced value, and in a second phase the swath height is maintained at a reduced value while the size of the print media advance is maintained at a second, further reduced value.

* * * * *